US007042805B1

(12) United States Patent
Kallman

(10) Patent No.: US 7,042,805 B1
(45) Date of Patent: May 9, 2006

(54) DISPOSABLE CONTACT LENS REMINDER CLOCK

(76) Inventor: Brandon E. Kallman, 631 Island Rd., Miami, FL (US) 33137

( * ) Notice: Subject to any disclaimer, the term of this patent is extended or adjusted under 35 U.S.C. 154(b) by 0 days.

(21) Appl. No.: 10/904,929

(22) Filed: Dec. 6, 2004

(51) Int. Cl.
*G04B 47/00* (2006.01)

(52) U.S. Cl. ..... 368/10; 368/242; 206/5.1

(58) Field of Classification Search ..... 368/10, 368/223, 89; 206/5.1
See application file for complete search history.

(56) References Cited

U.S. PATENT DOCUMENTS 4,909,382 A * 3/1990 Cuppari ..... 206/5.1
5,452,792 A * 9/1995 Zautke et al. ..... 206/5.1
6,038,997 A 3/2000 Madden
6,382,409 B1 * 5/2002 Scala ..... 206/5.1

* cited by examiner

*Primary Examiner*—Kamand Cuneo
*Assistant Examiner*—Jeanne-Marguerite Goodwin
(74) *Attorney, Agent, or Firm*—Malin, Haley & DiMaggio, P.A.

(57) ABSTRACT

A contact lens reminder clock for use with a contact lens tray to remind wearers of disposable contact lenses of the exact day since the lenses were first used. The reminder clock includes dual digital display showing days (and/or hours) since the clock was reset and may be permanently or temporarily mounted to the contact lens tray housing the contact lenses. On the specific day that a wearer installs the contact lenses for the first time, the wearer would depress the reset button for each display which begins the continuous time display digitally in days (and hours if desired) for each lens from the initiation date so that the wearer is able to determine at any time how many days each lens has been used.

5 Claims, 1 Drawing Sheet

DISPOSABLE CONTACT LENS REMINDER CLOCK

FIELD OF THE INVENTION

This invention relates to a device to protect people who wear disposable contact lenses from wearing the lenses for an excessive number of days and, specifically, to a contact lens reminder clock that is used in conjunction with a contact lens tray to remind a contact lens wearer specifically the exact number of days since the contact lenses were first used.

DESCRIPTION OF RELATED ART

Many people in society wear contact lenses. The use of disposable, non-permanent contact lenses, has become commonplace. Typically, with disposable contact lenses, the wearer can purchase a new pair of contact lenses periodically that can be worn for a prescribed number of days at which time the old lenses are actually thrown away. Exceeding the prescribed time period can be potentially dangerous to the health of the wearer. A typical wear period for contact disposable lenses could be from one day to two weeks to thirty days. During the thirty day period, the wearer often removes the lenses at night, puts the lenses in a contact lens storage trays (left and right). The lenses are allowed to soak and disinfect in special solutions. Extended wear contact disposable lenses may also be worn for more than one day at a time. However, in each case, there becomes a critical time factor beyond which wearing the lenses becomes unhealthy and may be even dangerous for the wearer to continue using the lenses.

One problem, that most contact lens wearers experience is remembering the exact date the user first installed the lenses and how many days have passed since first use. U.S. Pat. No. 6,038,997 issued Mar. 21, 2000 to Donna Madden shows an apparatus for trying to keep a tally for each lens by manipulating a counter rotating dial indicia. This device suffers from the fact that if you accidentally forget to align the reference mark on a daily basis or the device gets accidentally moved, the numbers would be wrong.

The present invention overcomes these problems by providing a very extremely accurate digital day counting clock that provides continuous monitoring of the time period, once initiated by the wearer of the lens. The clock is essentially foolproof in keeping track of the time from when the lenses were first installed and tell the wearer at a glance the number of days of use.

SUMMARY OF THE INVENTION

A contact lens reminder clock for each contact lens, left and right, for use with or without a contact lens holder tray to measure in time the number of consecutive days (and hours if desired) of wear of each of the lenses. The reminder clock includes a digital numerical display that shows numbers of days from a start time of zero, a clock timer circuit board having a micro processor timing circuit, a battery (or a plug in source of electricity), and a pair of reset display and time switches. The lens tray would include left and right lens separate storage chambers.

The reminder clock can be mounted permanently in a conventional contact lens tray at the factory or be purchased to be used and attached to an existing tray or mounted next to the tray.

In use, the contact lens wearer would depress a time display reset switch on the reminder clock for each lens (left and right) to begin the time sequence at the time the new disposable contact lenses are first inserted or the day of first use. Each lens clock display will then count the days (and hours) consecutively and continuously from time equal zero for that lens. The lens wearer then has a continuous monitor that is displayed digitally of days (and hours) of use that are used in conjunction with the lens tray so if the user does remove the lenses on a daily basis or every other day there is a constant reminder to the lens wearer of the number of days that the lenses have been is use. Thus, there is a separate timer/display for each lens that operates independently. If one lens is replaced during the wear cycle, the other lens will be on a completed different wear cycle.

It is an object of this invention to provide a contact lens reminder clock for contact lens wearers that displays the number of days consecutively that each lens has been worn from a start time of zero using a digital display.

It is another object of this invention to provide an inexpensive, small, accurate and foolproof contact lens reminder clock display that can be permanently mounted to a contact lens tray or portably attached thereto.

In accordance with these and other objects which will become apparent hereinafter, the instant invention will now be described with particular reference to the accompanying drawings.

DETAILED DESCRIPTION

Figure 1:
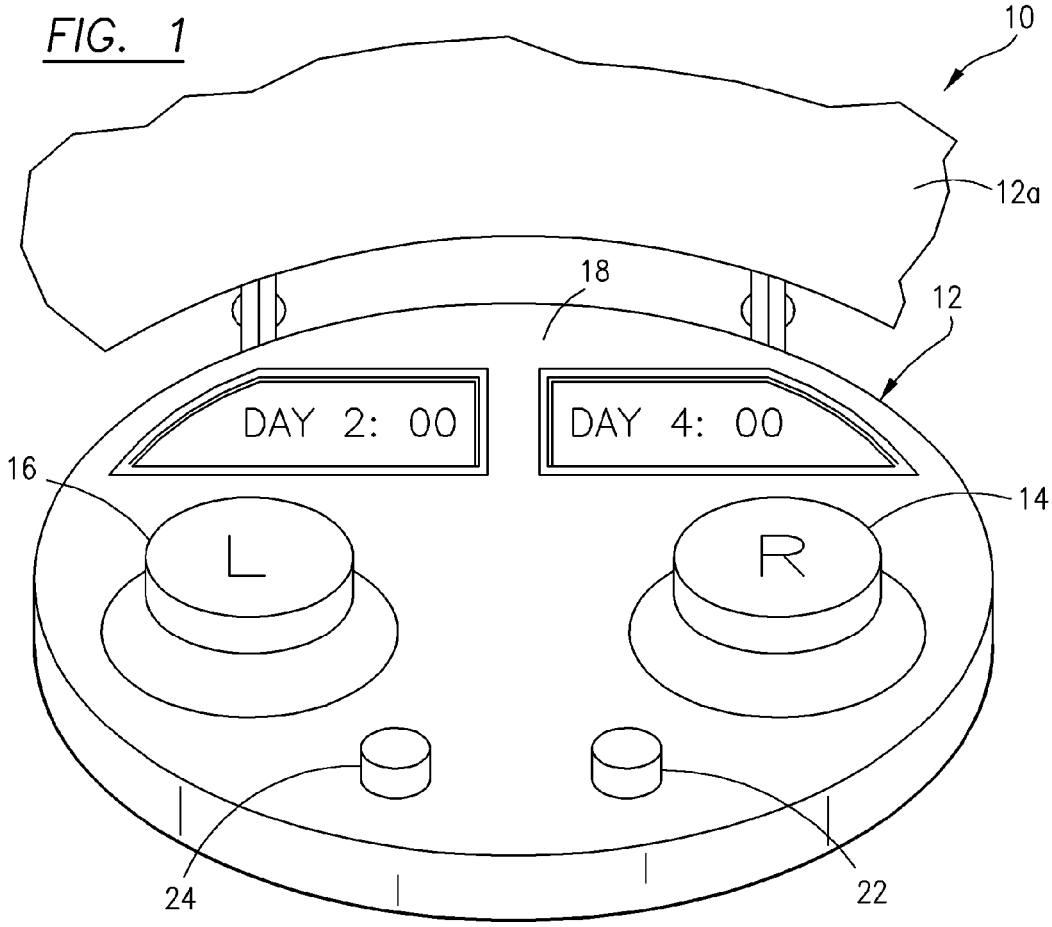
FIG. 1 shows a perspective view of the present invention.

Referring now to FIG. 1, the invention is shown generally at 10 comprising a rigid elliptically shaped housing 12 that may be made of a molded plastic that includes contact lens storage chambers which are concave, small, semi-spherical depressions each having caps 14 and 16 that can be screwed, by threads onto each chamber and sealed to hold liquid. As shown in FIG. 1, there is a right lens ("R") and a left lens chamber ("L") 16. Not shown in FIG. 1 is a circuit board and battery which are mounted inside of housing 12 and hidden from view in normal usage. What is shown however are two digital LCD displays 18 and 20 which in this case show days 2 "DAY 2:00" and "DAY 4:00" as the displayed alphanumeric content. The hours may also be displayed shown as 00. The housing has mounted a plurality of electrical switches 22 and 24 which are reset switches 22 and 24 for the displays 18 and 19, setting the digital displays 18 and 19 back to day/hour zero. Of course, these could be combined in different types of electrical switches that perform the various functions. The clock includes a light for nighttime reviewing. The reset buttons must be difficult to reset because accidental resetting would not be acceptable. Therefore, each reset switch 22 and 24 is recessed below the housing surface to require active reset.

Once a battery is inserted or plugged into an electrical receptacle, the system is always on and does not shut off.

To use the device shown in FIG. 1, the user would first insert a left contact lens and right contact lens on day zero. The reset switches for left and right lens 22 and 24 are individually manually depressed to start each display 18 and 20. The timing circuit then starts counting days and hours desired for each display 18 and 20. If the user takes the contact lenses out at night, then each chamber 14 and 16 can be opened by the user and each individual lens inserted in its individual compartment over night. The next morning, the user would then reinsert the lenses and note that a day had passed. The time displays 18 and 20 keep a continuous day by day (and hours if desired) monitor from the time each reset button 22 and 24 is pushed. Thus, the wearer of the contact lenses is in convenient contact with the timer displays because the day timer is attached and in this case part of the housing for the entire contact lens tray.

In an alternate embodiment, the clock including the timer displays 18 and 20 could be constructed as a separate unit and mountable to an existing contact lens tray. The timer unit could be glued or temporarily attached to a contact lens tray by Velcro or other suitable attachment devices. It will also include a combination of holders for different manufacturers and styles of holders to accommodate personal choices of holders.

Figure 2:
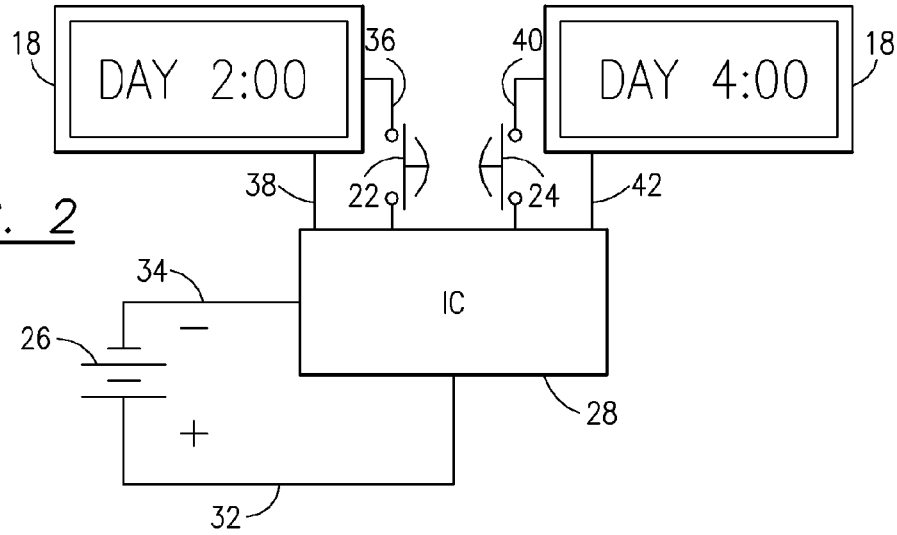
FIG. 2 shows a schematic diagram of the operation of the present invention.

Referring now to FIG. 2, the reminder clock circuitry is shown that includes a central processing unit circuit board 28 that includes the timing circuit, an electrical power source such as battery 26 (which could also be supplied by convention 110 AC outlet current) connected by conductors 32 and 34 which provides battery power to the circuit board 28. Another circuit having conductors 36 and 38 includes the reset button switch 22 is shown connected to the circuit board for resetting the left lens display 18. The digital display 18 is a liquid crystal (LCD) display that is connected electrically by circuit elements 36 and 38 to the circuit board 28 through reset switch 22. Conductors 40 and 42 connect circuit board 28 to right lens display 20. The operation of the circuit board and each LCD is conventional. The entire circuit diagram is shown in FIG. 2. The clock can be mounted in a separate single housing unit with a cover 12*a* that would make the clock independent and portable so that the clock could be attached to an existing contact lens tray or mounted besides the lens tray.

Thus, in use, the exact number of days from each contact lens first use is continuously displayed at the lens tray on two separate displays. Once one or both lenses are properly inserted in the wearer's eyes, the wearer depresses the reset buttons 22 and 24 starting each clock display 18 and 2 at day zero with hourly increments if desired. As each day passes, the wearer refers to the reminder clock so that the wearer can safely expend the proper number of days wearing each lens before the lens is ready to be disposed. Since the clock is small and light, the clock is very portable and can be carried with the user on trips or even on the person in a pocket.

The instant invention has been shown and described herein in what is considered to be the most practical and preferred embodiment. It is recognized, however, that departures may be made there from within the scope of the invention and that obvious modifications will occur to a person skilled in the art.

What is claimed is:

1. An accurate contact lens reminder clock that includes two independent digital displays comprising:

a timer circuit board;

a power supply connected to said timer circuit board;

two LCD displays attached to said circuit board for displaying left and right lens clock displays that include the number of days from a start reset time of zero; and a pair of reset switches for turning on the clock displays starting from zero to display a specific continuous number of days on each digital display.

2. A contact lens reminder clock as in claim 1, wherein:

a clock housing containing said timer circuit board, said power supply, said LCD displays, and said pair of reset switches is attachable to a contact lens tray.

3. A contact lens reminder clock as in claim 1, wherein:

said contact lens clock housing is removably attached to a contact lens tray.

4. A contact lens reminder clock as in claim 1, including:

said power supply being a battery.

5. A contact lens reminder clock as in claim 1, including:

a first and second reset switches for resetting each digital display all of which are connected to the timer circuit board.

* * * * *